US009349308B2

(12) United States Patent
Wine

(10) Patent No.: US 9,349,308 B2
(45) Date of Patent: May 24, 2016

(54) DYNAMIC APPLICATION OF A DESIGN ACROSS MULTIPLE PRODUCT PACKAGES

(71) Applicant: Juniper Books LLC, Boulder, CO (US)

(72) Inventor: Thatcher Eban Wine, Boulder, CO (US)

(73) Assignee: JUNIPER BOOKS, LLC, Boulder, CO (US)

( * ) Notice: Subject to any disclaimer, the term of this patent is extended or adjusted under 35 U.S.C. 154(b) by 524 days.

(21) Appl. No.: 13/673,812

(22) Filed: Nov. 9, 2012

(65) Prior Publication Data

US 2013/0113825 A1 May 9, 2013

Related U.S. Application Data

(60) Provisional application No. 61/557,736, filed on Nov. 9, 2011.

(51) Int. Cl.
*G09G 5/00* (2006.01)
*G09F 19/12* (2006.01)

(52) U.S. Cl.
CPC ..... *G09F 19/12* (2013.01)

(58) Field of Classification Search
CPC ..... G06T 11/60; G06T 19/00; G06T 11/00; G06F 9/44458; G06F 3/0481
See application file for complete search history.

(56) References Cited

U.S. PATENT DOCUMENTS

| | | | | |
|---|---|---|---|---|
| 6,760,638 | B1 * | 7/2004 | Love et al. | 700/98 |
| 7,325,677 | B2 | 2/2008 | Gelardi et al. | |
| 8,004,713 | B2 | 8/2011 | Knodt | |
| 8,131,009 | B2 | 3/2012 | Levine et al. | |
| 8,169,435 | B2 * | 5/2012 | Van Bael et al. | 345/419 |
| 2002/0057453 | A1 * | 5/2002 | Michaelis et al. | 358/1.15 |
| 2008/0105593 | A1 * | 5/2008 | Kleinsmith | 206/736 |
| 2008/0122840 | A1 * | 5/2008 | Falco | 345/420 |
| 2008/0240887 | A1 | 10/2008 | Gotoh et al. | |
| 2009/0102110 | A1 | 4/2009 | Endoh et al. | |
| 2009/0162496 | A1 * | 6/2009 | Henderson et al. | 426/87 |
| 2009/0251714 | A1 * | 10/2009 | Franco et al. | 358/1.9 |
| 2009/0292682 | A1 * | 11/2009 | Robbins | 707/3 |
| 2010/0294690 | A1 * | 11/2010 | Butler et al. | 206/459.5 |
| 2010/0294760 | A1 * | 11/2010 | Butler et al. | 220/23.83 |
| 2011/0047489 | A1 * | 2/2011 | Orr et al. | 715/764 |
| 2012/0285303 | A1 * | 11/2012 | Porat | 83/39 |

OTHER PUBLICATIONS

Amazon Listing for Baseball, 2 Pages.

* cited by examiner

*Primary Examiner* — Todd Buttram
(74) *Attorney, Agent, or Firm* — Marsh Fischmann & Breyfogle LLP; Daniel J. Sherwinter

(57) ABSTRACT

Systems and methods are described for dynamically applying a single design across a display field composed of visual surfaces of a number of non-adjoined product packages to create an impression of a single, unified aesthetic. Geometries and layouts of product packages are used to calculate a display field. A source image can be mapped to some or all of the display field to generate one or more field maps. Individual package images can be generated from the field maps, according to various factors, including the individual product package geometries and layouts. Some embodiments allow the generated package images to be previewed, the entire display field to be virtually previewed, and/or the package images to be output.

24 Claims, 8 Drawing Sheets

DYNAMIC APPLICATION OF A DESIGN ACROSS MULTIPLE PRODUCT PACKAGES

FIELD

Embodiments relate in general to image processing and more particularly, but not by way of limitation, to dynamic application of a display field design across a layout of multiple non-adjoined packaging surfaces.

BACKGROUND

There are many contexts in which it is desirable to have a coordinated (e.g., an aesthetic and/or attractive) display of otherwise basic product packaging elements, and the like. For example, a bookshelf can be filled with books having different heights and widths, different types and designs of bindings, etc. While some bindings can be attractive, many are not, or the overall collection has an uncoordinated or non-cohesive appearance. Similarly, a store display can include product boxes of one or more products in stacks or other layouts. In these and/or other contexts, it can be desirable to use the visual portions of the packaging (e.g., of the product boxes, book bindings, etc.) to form an overall coordinated display field, while accounting for the geometry and layout of the product packages.

A number of traditional techniques have been used to spread a single image across multiple surfaces. In some traditional approaches, highly tedious and manual techniques are used to design multiple packages as a unit (e.g., for a multi-volume work, like an Encyclopedia). More recently, computer systems are used to cut a source image into pieces (e.g., tiles), which are assigned to a particular package surface like a mosaic. These approaches, however, are limited in a number of ways. One such limitation is that the approaches tend to be fixed to a particular installation—the approaches provide no way to dynamically adjust parameters to accommodate a new source image, new target package geometries or layouts, etc. For example, if above approaches are used to spread a design across the outside bindings of multiple book volumes, appreciable effort would be involved in reapplying the design to even a slightly different set of books. Another such limitation is that traditional computational approaches typically operate in only one or two dimensions. For example, an image can be tiled across the outside surfaces of a number of packages in a single plane. However, there tends not to be any consideration of a third dimension to the packaging, a third dimension to the display field, empty space in the display field, etc.

BRIEF SUMMARY

Among other things, systems and methods are described for dynamically applying a single design across a display field composed of visual surfaces of a number of non-adjoined product packages to create an impression of a single, unified aesthetic. Geometries and layouts of product packages are used to calculate a display field. One or more source images can be mapped to some or all of the display field to generate one or more field maps. Individual package images can be generated from the field maps, according to various factors, including the individual product package geometries and layouts. Some embodiments allow the generated package images to be previewed, the entire display field to be virtually previewed, and/or the package images to be output.

According to one set of embodiments, a method is provided for dynamically applying a design across multiple product packages. The method includes: receiving a package geometry for each of a number of product packages (e.g., books, product boxes, retail containers, etc.) and a layout indicating a package position for each of the product packages (e.g., stacked, oriented horizontally and/or vertically, on a table or shelf, etc.); calculating a display field as a function of the package geometries and the layout, the display field comprising a set of portions of the product packages that are visible when the respective product packages are positioned according to the layout; mapping a source image to the display field to generate a field map using a computer-implemented package image generator; and generating, by the computer-implemented package image generator, a package image associated with each of the set of portions of the product packages of the display field according to the field map and the package geometries. Some such embodiments further include receiving a package input data from a user via a graphical user interface and determining the package geometry and the layout according to the package input data. Other such embodiments further include displaying a preview of each package image, displaying a preview of the field map in context of at least a portion of the package geometries positioned according to the layout, and/or outputting each package image to an output system (e.g., a printer).

According to another set of embodiments, a system is provided for dynamically applying a design across multiple product packages. The system includes a display field characterization subsystem and a package image generation subsystem. The display field characterization subsystem is operable to: receive a package geometry for each of a number of product packages and a layout indicating a package position for each of the product packages; and calculate a display field as a function of the package geometries and the layout, the display field comprising a set of portions of the product packages that are visible when the respective product packages are positioned according to the layout. The package image generation subsystem is in communication with the display field characterization subsystem and is operable to: map a source image to the display field to generate a field map; and generate a package image associated with each of the set of portions of the product packages of the display field according to the field map and the package geometries. Some such embodiments further include a package characterization subsystem, in communication with the display field characterization subsystem, and operable to: receive package input data from a user (e.g., via a graphical user interface); and generate the package geometry for each of the product packages and the layout indicating the package position for each of the product packages according to the package input data. In certain such embodiments, the package characterization subsystem is implemented in a client system in communication with a server system over a communications network; and the server system includes the display field characterization subsystem and the package image generation subsystem.

According to yet another set of embodiments, a computer program product is provided that resides on a non-transitory, processor-readable medium and has processor-readable instructions, which, when executed, cause a processor to perform steps. The steps include: receiving a package geometry for each of a number of product packages and a layout indicating a package position for each of the product packages; calculating a display field as a function of the package geometries and the layout, the display field comprising a set of portions of the product packages that are visible when the respective product packages are positioned according to the layout; mapping a source image to the display field to generate a field map; and generating a package image associated with each of the set of portions of the product packages of the display field according to the field map and the package geometries.

BRIEF DESCRIPTION OF THE DRAWINGS

The present disclosure is described in conjunction with the appended figures.

Figure 1:
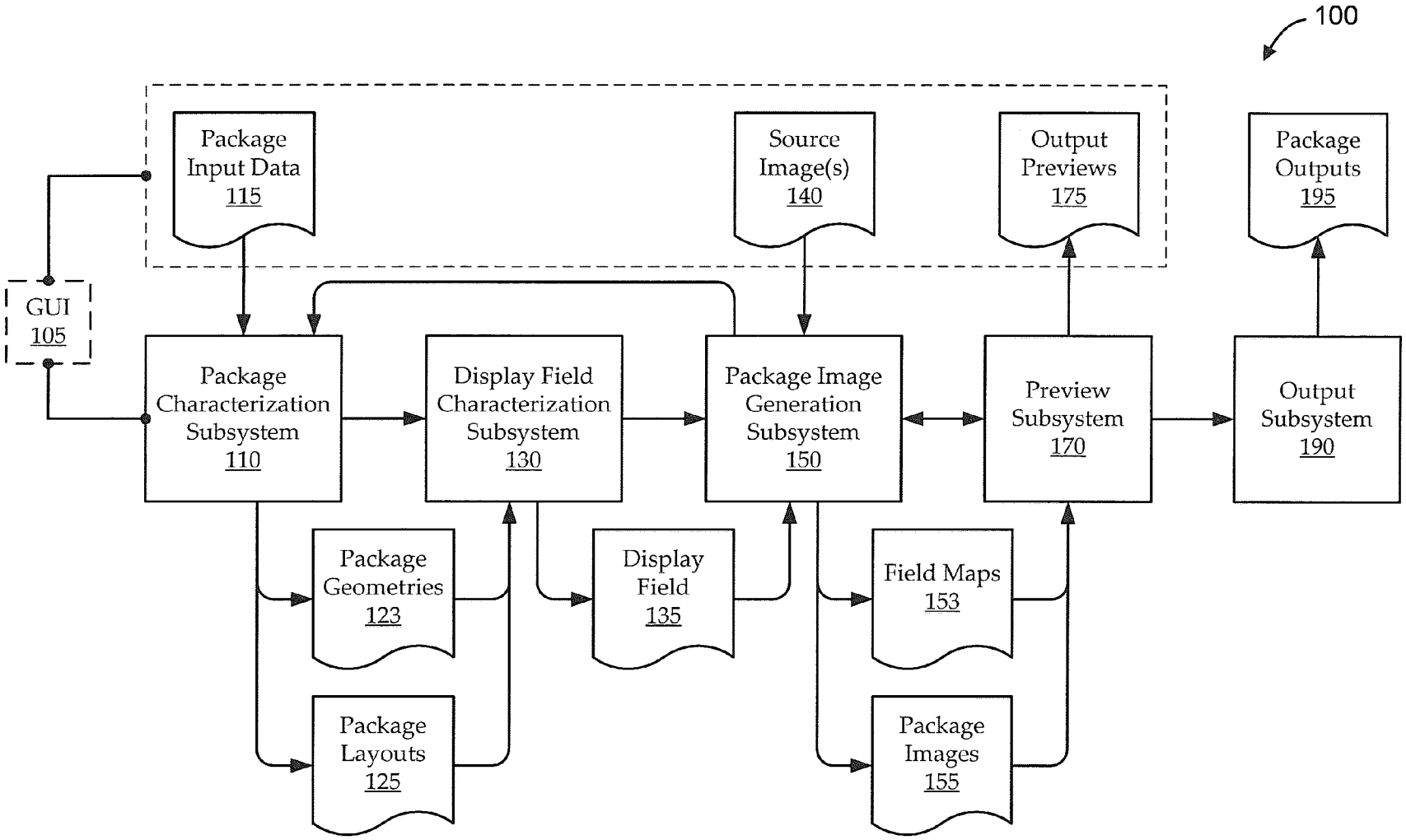
FIG. 1 shows a block diagram of an embodiment of a product package design environment, according to various embodiments.

In the appended figures, similar components and/or features can have the same reference label. Further, various components of the same type can be distinguished by following the reference label by a second label that distinguishes among the similar components. If only the first reference label is used in the specification, the description is applicable to any one of the similar components having the same first reference label irrespective of the second reference label.

DETAILED DESCRIPTION

There are many contexts in which it is desirable to have an aesthetic display of otherwise non-aesthetic elements. For example, a store display can include bland product boxes of one or more products in stacks or other layouts. Similarly, a bookshelf can be filled with books having different heights and widths, different types and designs of bindings, etc. While some bindings can be attractive, many are not, or the overall collection has an incoherent or generally unattractive appearance. For example, each book is typically a single, separately designed and created unit that has an identity and aesthetic independent of the other books that surround it. Each book cover, whether it is the binding itself or a book jacket over the binding, is designed and created solely for that book so that a bookshelf with twenty books can have twenty different aesthetics. In these and/or other contexts, it can be desirable to use the visual portions of the packaging (e.g., of the product boxes, book bindings, etc.) to form an overall aesthetic display field that accounts for the geometry and layout of the product packages.

A number of techniques have been used traditionally to spread a single image across multiple surfaces, like a mosaic. Some approaches are highly tedious and manual, while others use computer systems to cut a source image into pieces and assign the pieces to particular package surfaces. These approaches tend to be limited in a number of ways. One such limitation is that the approaches tend to be fixed to a particular installation—the approaches provide no way to dynamically adjust parameters to accommodate a new source image, new target package geometries or layouts, etc. Another such limitation is that traditional computational approaches typically operate in only one or two dimensions, without accounting for a third dimension to the packaging, a third dimension to the display field, empty space in the display field, selected or multiple viewing directions, etc. Similarly, traditional approaches do not typically account for surface peculiarities, like material thickness and curvature, which can affect mapping of designs to the display field.

Embodiments described herein provide systems and methods for applying a single image or design across a display field composed of visual surfaces of a number of non-adjoined product packages to create an impression of a single, unified aesthetic. Geometries and layouts (e.g., the sizes, shapes, relative or absolute positions, orientations, etc.) of multiple product packages (e.g., book bindings, product boxes, etc.), are used to calculate a two- or three-dimensional display field. The display field is set of planes or other geometries that manifest the desired aesthetic (e.g., the collective visible geometry created by laying out the package surfaces). A source image (e.g., text, one image, multiple images, etc.) can be mapped to some or all of the display field to generate one or more field maps. Individual package images can be generated from the field maps, according to various factors, including the individual product package geometries and layouts. Some embodiments allow the generated package images to be previewed, the entire display field to be virtually previewed, and/or the package images to be output (e.g., to a printer).

While many traditional approaches effectively treat visible surfaces as tiles of a mosaic, embodiments described herein account for the entirety of the display field, including the component geometric and layout characteristics of the individual packages. For example, the display field can dynamically adjust to changes in individual package characteristics, include three-dimensional features (e.g., surfaces that are not substantially co-planar), and/or adapt to packaging peculiarities (e.g., where edges are rounded, so that a visible surface of one package may be separated from a corresponding visible surface of another, directly adjacent package). Further, embodiments can account for packaging characteristics that are not visible in the display field, like a front or back cover of a book, or a front or back "flap" of a book cover. In general, while traditional approaches focus either on individual packaging or on the collective display field as an entity (e.g., a large plane of tiles), embodiments concurrently account for both the overall aesthetic of the display field and the individual packages that make up the display field.

For the sake of illustration, some implementations are used with books and the like (e.g., hardcover books, softcover books, printed and bound e-books, media jackets, etc.). For example, implementations can be used to create a unified aesthetic for a multi-volume edition of a novel; a group of ten books by the same author or about a similar subject; a shelf of different books in a personal collection; a bookcase of books in a hotel lobby, cruise ship library, or business office; an array of multiple bookcases filled with books; and/or any other context on which it is desired to display a corporate logo, work of art, text, or other cohesive aesthetic across multiple book spines. Other implementations can be used with media packaging, such as compact disc cases, digital video disc boxes, or album jackets. Still other implementations can be used with point-of-sale product packaging, such as a promotional display for a new computer composed of stacks of computer boxes, or a promotional display for a restaurant composed of an arrangement of pizza boxes and cookbooks.

In the following description, numerous specific details are set forth to provide a thorough understanding of various embodiments. However, one having ordinary skill in the art should recognize that the invention can be practiced without these specific details. In some instances, circuits, structures, and techniques have not been shown in detail to avoid obscuring the present invention.

Turning to FIG. 1, a block diagram is shown of an embodiment of a product package design environment 100, according to various embodiments. The product package design environment 100 includes a package characterization subsystem 110, a display field characterization subsystem 130, a package image generation subsystem 150, a preview subsystem 170, and an output subsystem 190. In some embodiments, package input data 115 is provided to the package characterization subsystem 110. The package input data 115 can include any useful information for determining product packaging geometry, layout, and/or other characteristics. In some implementations, information is provided by a user via a graphical user interface (GUI) 105. For example, the user enters the package input data 115 using a client application on a user device, like a desktop computer, laptop computer, tablet computer, or smart phone.

The package input data 115 can be provided in various ways. In some implementations, numerical data is entered to describe each packaging surface's dimensions (e.g., height and width), absolute or relative position, orientation, etc. Other information can also be entered to describe rounded edge radii, tapers, bevels, or other such geometric features; material type and/or thickness; etc. Still other information can be included, such as a product identifier, user name, etc. In other implementations, some package input data 115 is derived from other provided package input data 115. In one example, an International Standard Book Number (ISBN) of a book is provided, and a local or remote system is queried to retrieve geometric and other information for the corresponding book. In another example, standard packaging can be selected (e.g., for a compact disk case or the like). In yet another example, three-dimensional models of product packages are used to derive geometric, positioning, and/or orientation information.

Having characterized the packaging via the package characterization subsystem 110, embodiments of the package characterization subsystem 110 generate package geometries 123 and package layouts 125 in a format usable by other subsystems. For example, the package characterization subsystem 110 characterizes each product package as a dataset that includes at least its relevant geometric and layout characteristics. Each package's package geometry 123 and a package layout 125 can be derived from the dataset. The package layout 125 can be derived in any suitable manner, for example, as a layout position (e.g., and/or orientation, relative or absolute, etc.) for each package, as an array or other data structure describing the overall layout of all the packages, etc.

Embodiments of the display field characterization subsystem 130 use the package geometries 123 and package layouts 125 to determine a display field 135. In some embodiments, the display field characterization subsystem 130 determines the display field 135 automatically by calculating which surfaces of which packages will be visible when the packages are arranged according to the package layout 125. For the sake of illustration, a set of books is defined in the package characterization subsystem 110, each having a "package" that is its respective book binding (or book jacket). In the package characterization subsystem 110, the package geometry 123 is defined as three contiguous surfaces: a "back cover," a "spine," and a "front cover" (a book jacket could also include a "back flap and a "front flap"). Each surface is assigned geometric properties (e.g., height and width) and relative orientations, and an orientation of the book is defined (e.g., vertical, spine facing outward; front cover facing east; etc.). When package geometries 123 are defined for a shelf full of these defined books, a package layout 125 is defined in the package characterization subsystem 110, indicating the relative (or absolute) positions, orientations, etc. of the books. Some implementations o the display field characterization subsystem 130 determine the display field 135 with this information, so that any fully (and, in some implementations, partially) visible surfaces are part of the three-dimensional display field 135.

In many book displays, there are additional elements that can affect the display field 135. For example, it may be desired to display the books on a bookshelf, between bookends, etc. Accordingly, embodiments of the package characterization subsystem 110 and/or the display field characterization subsystem 130 support definition and inclusion of those types of additional geometries in determining the display field. For example, if all but the spines of the books are substantially obscured by a bookshelf (e.g., the books are displayed within a threshold distance and at a threshold depth with respect to the bookshelf's inner walls, shelves, etc.), implementations may include only the remaining visible surfaces (i.e., the spines) in the display field 135.

Some embodiments allow particular package surfaces to be identified for inclusion in or exclusion from the display field 135. For example, the user (e.g., via the GUI 105) can define the package geometries 123 to have particular surfaces, like the "spine," called out for inclusion in the display field 135. Other embodiments allow particular viewing directions to be defined. Suppose, for example, that a point-of-sale desired to display a number of product boxes in their front window, and the front window is primarily visible only from the direction of the street. When the boxes are stacked according to the desired package layout 125, many surfaces of different boxes are visible from various directions, but consumers will primarily only be able to view the display through the window from the street. Embodiments allow the user to define the viewing direction (e.g., to correspond to viewing from the street), so the display field 135 will not include surfaces that would not be visible from that direction.

Still other embodiments allow portions of the display field to be selected, masked off, prioritized, and/or otherwise affected. Some implementations of the display field characterization subsystem 130 include functionality accessible via the GUI 105, so that a user can manually modify the display field in any suitable manner. For example, the display field characterization subsystem 130 can display a virtual three-dimensional layout view according to the package geometries 123 and the package layout 125 that includes a representation of the display field 135. A user can then manually select surfaces, highlight portions of the display field 135, select a viewing direction, add obscuring objects, and/or otherwise interact with the virtual layout view to affect the resulting display field 135.

Different embodiments can represent the display field 135 in different ways for display, calculation, and/or storage purposes. In some implementations, the display field 135 is represented one or a small number of planes that approximates the display field 135. In other implementations, the display field 135 is represented as a set of polygons. The polygons can be tightly fit to the package geometries 123, which can create a more precise display field 135 representation, but can consume appreciable storage and/or processing resources and can more accurately replicate any errors or approximations in the package geometry 123 definitions. Alternatively, the polygons can be loosely fit to the package geometries 123. Some embodiments allow the user to select, adjust, and/or preview the effect of different types of polygon fitting. Any suitable representation of the display field 135 can be used in embodiments for various purposes.

The display field 135 is used by embodiments of the package image generation subsystem 150 to determine how to map one or more source images 140 to the package geometries 123. For the sake of simplicity, embodiments are described with reference to a "source image" supplied by a user (e.g., via the GUI 105). However, any suitable design or aesthetic can be provided in any suitable way as the source image 140 without departing from the scope of embodiments. For example, multiple images can be provided for different portions of a display field 135, normal or stylized text can be provided, etc. In certain implementations, rather than receiving the source image 140 from a user, the source image 140 can be received from a database (e.g., based on an association with a package identifier), generated dynamically according to various parameters, etc. Further, embodiments of the package image generation subsystem 150 allow the source image 140 to be adjusted (e.g., re-colored, re-sampled, resized, etc.) before being used.

Embodiments of the package image generation subsystem 150 effectively determine how to map the source image 140 to the display field 135 to create a desired overall display aesthetic (e.g., field maps 153), while also determining how to map the source image 140 and/or additional images to the individual package geometries 123 (e.g., package images 155). According to some embodiments, the package image generation subsystem 150 maps the source image 140 to the display field 135 to generate one or more field maps 153. The field maps 153 effectively define how the display field 135 will appear in two or three dimensions. For example, all or a portion of the source image 140 is applied to each visible surface or group of surfaces (e.g., planes, polygons, etc.) to generate the field maps 153. In some implementations, the mapping of the source image 140 to the display field 135 is performed automatically using projection, surface texturing, or other techniques. In other implementations, the mapping can be manually affected. For example, a user can select (e.g., via the GUI 105) which source image 140 or portions of a source image 140 to apply to which portions of the display field 135, or the user can manually edit (e.g., resize, rotate, crop, etc.) the one or more source images 140 for placement on the display field 135.

The package image generation subsystem 150 also generates one or more package images 155 associated with each, individual product package. In some implementations, the package images 155 are generated to be applied (e.g., printed) onto a product package. For example, the package images 155 can be used to generate a label, sticker, or laminate to apply to an existing package; a computer numerical controlled (CNC) program or other pattern for cutting out of an existing package; etc. In other implementations, the package images 155 are generated as packaging to apply over existing packaging. For example, the package images 155 can be printed onto a book jacket to wrap over an existing book binding. In still other implementations, the package images 155 are used to create the packaging itself (e.g., according to the defined package geometries 123). For example, the package images 155 and package geometries 123 can be used to generate cross-sections or three-dimensional models (e.g., computer-aided drafting (CAD) models) for use in manufacturing the packaging, book bindings, printed sheet stock (e.g., cardboard, sheet metal, etc.) for folding into product packaging, etc. Embodiments of the product package design environment 100 can adjust one or more parameters to account for the different types of packaging options. For example, the package geometries 123, package layouts 125, display fields 135, field maps 153, package images 155, and/or other information can be generated to account for material thickness, edge rounding, and/or other packaging characteristics.

According to some embodiments, the package images 155 are generated to account for portions of the packaging not visible (or selectively not included) in the display field 135. For the sake of illustration, a book is defined in the package characterization subsystem 110, having a "package" that is its book jacket. In the package characterization subsystem 110, the package geometry 123 is defined as five contiguous surfaces—a "back flap," a "back cover," a "spine," a "front cover," and a "front flap"—with only the "spine" identified as (or determined to be) visible in the display field 135. While the field map 153 may include only the spine (as visible in the display field 135), it may be desirable to generate an image for the entire book jacket (e.g., including one or more surfaces not visible in the display field 135 when the book is shelved, but visible should someone remove the book from the shelf). Accordingly, additional source images 140 and/or other information (e.g., book information, like chapter titles, summary, author information, etc.) can be included in the package images 155.

These additional source images 140 and/or other information can be provided in any suitable way. In some implementations, the information is provided by a user via the GUI 105. In other implementations, the information is automatically retrieved, generated, derived, etc. from a data store (e.g., a local or remote database). For example, the ISBN of the book is used to look up the title, author, copyright information, cover image, and other relevant information. Still other implementations allow the user to retrieve, generate, derive, or otherwise acquire information or information fields, then (e.g., via the GUI 105) manually select which information to include and how to lay the information out in the package images 155. For example, book jackets can be defined for a number of books to have front and back flaps of a particular width (regardless of other book dimensions), and each flap can be automatically filled with information retrieved from a database according to fields and layouts manually defined by the user.

In some embodiments, the preview subsystem 170 is included to allow the user to preview the package images 155 and/or the field maps 153 as output previews 175. Some embodiments preview the package images 155 as flattened images and/or in as virtual, three-dimensional representations of the package images 155 as they would be seen in a realized display. Other embodiments also preview the display field 135. For example, a three-dimensional, virtual display is generated from the package geometries 123, package layouts 125, and field maps 153 to render how the display field 135 would look in a realized display. In some implementations, the display field 135 is rendered as a virtual projection of the field maps 153 viewed from a particular direction. In other implementations, the display field 135 is rendered as a textured, three-dimensional model of the field maps 153. The display interface (e.g., the GUI 105) can provide the user with various controls to zoom, rotate (in two or three dimensions), and/or otherwise manipulate the output previews 175.

Some embodiments of the product package design environment 100 further include an output subsystem 190 for outputting package outputs 195. The package outputs 195 effectuate all or a portion of the desired display field 135 when configured according to the package geometries 123 and arranged according to the package layouts 125. The package outputs 195 can include any suitable output depending at least on the package images 155. For example, the output subsystem 190 can include a printer (e.g., for printing book jackets, labels, stickers, laminates, etc.), a CNC machine (e.g., for automatically cutting and/or bending materials into a new or existing package), a specialty packaging machine (e.g., a book binding machine for printing and binding a book, like a traditional or e-book), a three-dimensional printer (e.g., a selective laser sintering machine or the like for printing three-dimensional packaging or packaging elements), etc.

In one illustrative embodiment, an application is implemented on or accessible via a smart phone or other mobile device. A user can utilize functionality of the mobile device to interact with functionality of the various subsystems. For example, the source image 140 can be acquired and/or manipulated using the mobile device's camera and/or a third-party application (e.g., a photo editing application running on the mobile device or over a network), or acquired via a network (e.g., from a public or private image store, etc.). Similarly, package input data 115 can be acquired, manipulated, or otherwise affected via the mobile device. For example, package geometries 123 can be acquired using camera, range-finding (e.g., laser, photographic, etc.), interactive measurement, and/or other mobile device functions; a photograph of a product package element (e.g., a book cover or barcode) can be acquired via the mobile device and communicated to a database to look up geometric, bibliographic, and/or other information about the product package; etc. Additionally, functionality of the mobile device (e.g., a touchscreen or other interface) can be used to manipulate the display field, interact with the output previews 175, etc. The mobile device can be further used to communicate some or all of the information to third-party systems, for example, the output subsystem 190, a payment processing subsystem, an authentication subsystem, etc.

While the product package design environment 100 is shown as a single environment, embodiments can be architected in various ways and can include only a subset of the illustrated subsystems. In some embodiments, the package characterization subsystem 110, display field characterization subsystem 130, and package image generation subsystem 150 are all implemented as part of a system (e.g., an application for execution in a computational environment). Such embodiments can also include and/or be in communication with the preview subsystem 170 and/or one or more output subsystems 190. Many other architectures are possible without departing from the scope of embodiments.

Figure 2:
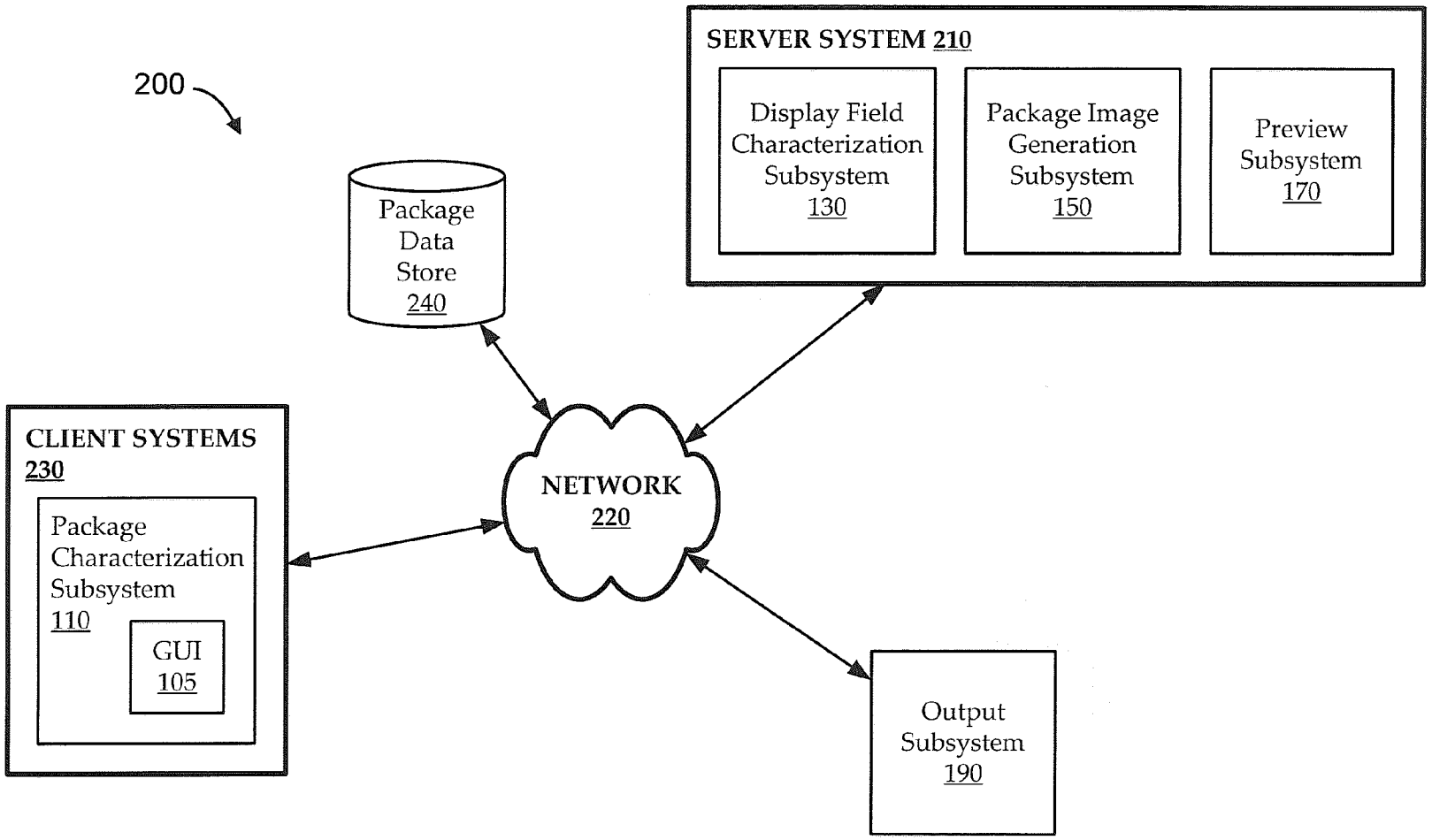
FIG. 2 shows an illustrative network architecture for implementing a product package design environment, like the one illustrated in FIG. 1, according to various embodiments.

FIG. 2 shows an illustrative network architecture 200 for implementing a product package design environment, like the one illustrated in FIG. 1, according to various embodiments. The network architecture 200 includes a server system 210 in communication with one or more client systems 230 over a network 220. In some embodiments, the server system 210 and the one or more client systems 230 have a client-server relationship via a client-server communications link over the network 220. In other embodiments, the server system 210 and the client systems 230 communicate using different architectures and/or protocols (e.g., peer-to-peer, etc.). The network 220 can include any suitable wired and/or wireless, public and/or private communications links. In one implementation, the network 220 is the Internet. In another implementation, the network 220 is a local area network (LAN) or a virtual LAN (VLAN). Communications over the network 220 can involve authentication, encryption, rights management, and/or other techniques for user, access, and or service control.

Embodiments of the server system 210 are implemented in any suitable manner, for example on one or more computational environments (e.g., server computers) that are collocated or distributed. In one implementation, the server system 210 is implemented as an enterprise application running on an enterprise application server. In another implementation, the server system 210 is a cloud-based application running on a virtual sever accessible via the Internet.

As illustrated, the server system 210 can include a display field characterization subsystem 130 and a package image generation subsystem 150. The display field characterization subsystem 130 and the package image generation subsystem 150 may be similar or identical to those described above with reference to FIG. 1. As described above, implementations of these subsystems generate their own data automatically according to data received from a user. For example, the display field characterization subsystem 130 generates a display field 135 according to received package geometries 123 and package layouts 125, and the package image generation subsystem 150 generates field maps 153 and package images 155 according to the received display field 135 and one or more source images 140. Some embodiments of the server system 210 further include a preview subsystem 170, which can be similar or identical to the preview subsystem 170 of FIG. 1. Implementations of the preview subsystem 170 generate output previews 175 from received field maps 153 and/or package images 155.

The server system 210 can receive data from and communicate data to the one or more client systems 230 over the network 220. Embodiments of the client systems 230 are implemented in any suitable environment. For example, each client system 230 can be a computational system (or an application of a computational system) implemented in a desktop computer, a laptop computer, a tablet computer, a smart phone, etc. Each client system 230 can include a package characterization subsystem 110, which can be similar or identical to the package characterization subsystem 110 of FIG. 1. In some implementations, the package characterization subsystem 110 includes a GUI 105. As described above, a user can provide package input data 115 to the package characterization subsystem 110 via the GUI 105. The package characterization subsystem 110 can generate package geometries 123 and package layouts 125 according to the provided package input data 115 and/or other data, and can communicate the generated data over the network 220 to the server system 210 for further processing.

As described with reference to FIG. 1, embodiments allow certain data to be retrieved from a package data store 240 (e.g., via the network 220). For example, a user can provide an ISBN via the GUI 105, and the package characterization subsystem 110 can look up the ISBN in the package data store 240 to retrieve relevant data about a corresponding book (e.g., geometric information, number of pages, title, author, copyright information, etc.). Similarly, the package data store 240 can store package templates (e.g., standard or pre-stored geometries of product packages), package artwork, data previously generated by a product package design environment (e.g., package geometries 123, package layouts 125, display fields 135, source images 140, field maps 153, package images 155, output previews 175, package outputs 195, etc.), configuration data (e.g., user preferences, credentials, etc.), and/or any other useful data to facilitate functionality of the product package design environment.

In some embodiments, the GUI 105 of the package characterization subsystem 110 can also be used as a portal to functionality of other subsystems, including those of the server system 210. For example, some implementations of the GUI 105 can be used to affect generation of the display field 135 by the display field characterization subsystem 130. Other implementations of the GUI 105 are used to view and manipulate output previews 175 generated by the output subsystem 190. In one illustrative implementation, the package characterization subsystem 110 is a client application running on a client system 230 in communication with a remote server system 210. The user can access any interactive functionality of any server system 210 or client system 230 subsystems via the GUI 105. The GUI 105 can also be used to facilitate functionality, such as user authentication, file storage access, etc.

As illustrated, some embodiments of the network architecture 200 include one or more output subsystems 190 that are in communication with other systems via the network 220. For example, the output subsystem 190 can include a network printer accessible by the server system 210 and/or the client systems 230 via the network, or the output subsystem 190 is a third-party system (e.g., a book binding system of a book binding company) operable to receive package images 155 and any other relevant data from the server system 210 and/or the client systems 230 via the network 220. For the sake of illustration, an online e-book distributer contracts with a physical book publisher. The distributer offers a relatively thin client application for download to client devices that includes functionality of the package characterization subsystem 110, including the GUI 105 and related portal functions. The distributor serves functionality of the display field characterization subsystem 130, the package image generation subsystem 150, and the preview subsystem 170 from virtual server space owned and operated by the distributor. The distributor also maintains a rich database (package data store 240) of geometric, bibliographic, and other information relating to its e-book offerings, as well as information relating to its subscribers. A user can run the client package characterization subsystem 110 application, and log in as a client to the server system 210 via the network 220. After providing information to and interacting with all the various subsystems and functions of the client and server subsystems, the user has generated a virtual set of books from corresponding e-books, including custom-designed book bindings that manifest a desired aesthetic in a display field 135. The user can then opt to purchase the physical manifestations of the selected and custom-packaged set of e-books, at which time the physical book publisher receives any information relevant to the physical production of the books. The physical books can then be sent to the user.

Figure 3B:
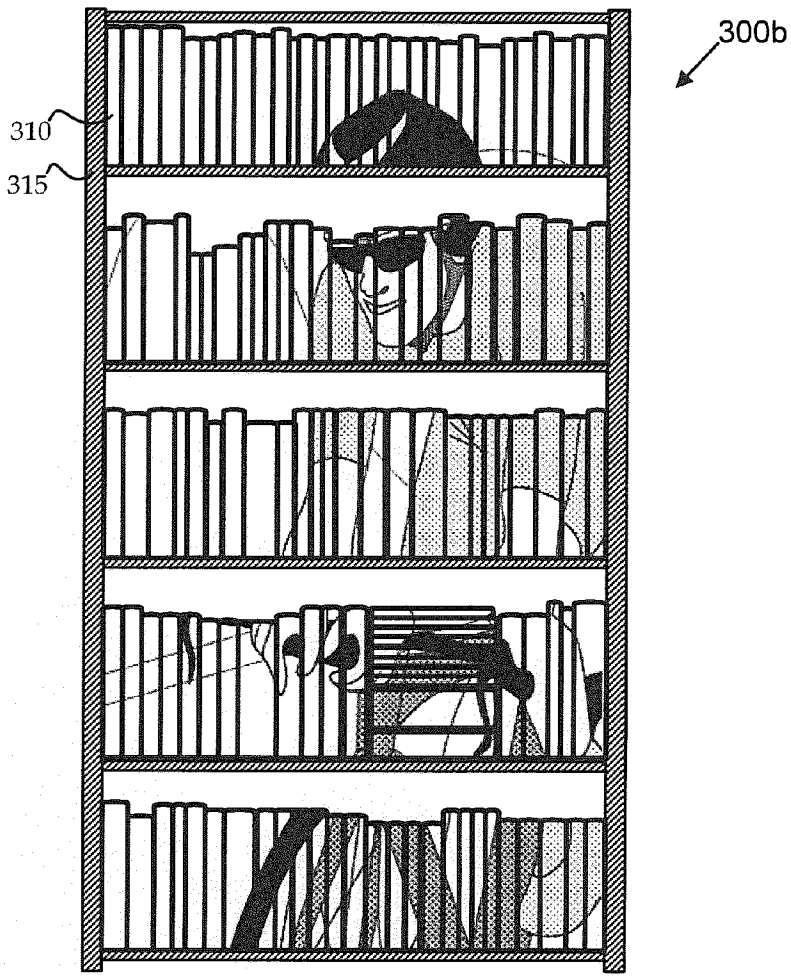
FIGS. 3A and 3B show an illustrative source image and a final realized display, respectively.
Figure 3A:
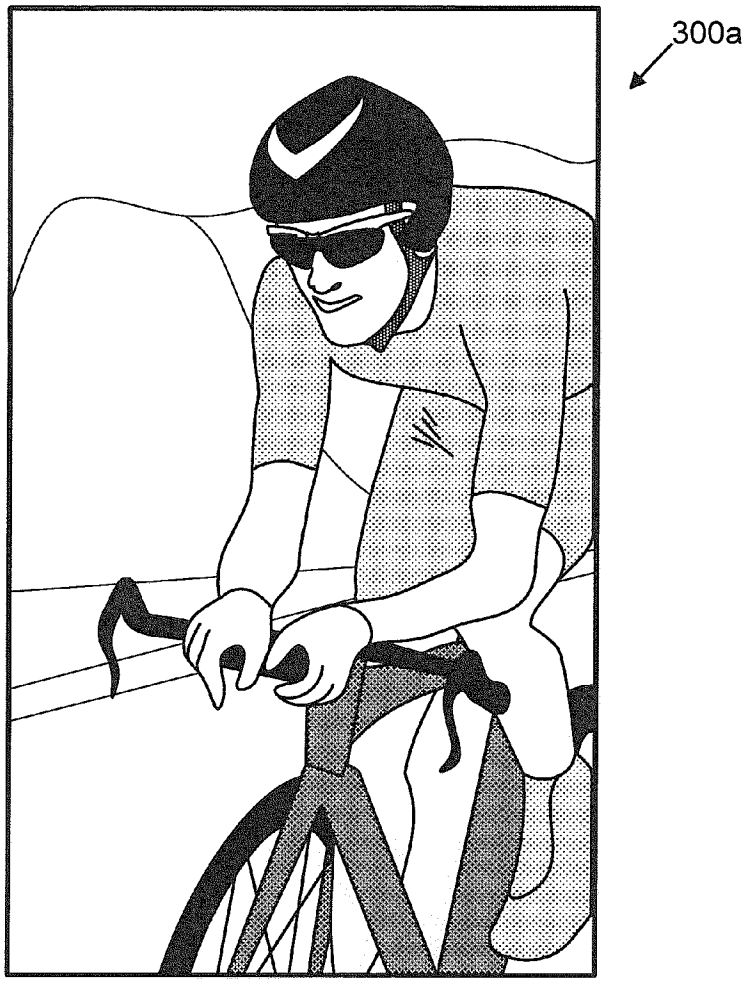

FIGS. 3A-5 show illustrations of certain functionality. The illustrations are only intended to highlight certain functionality in the illustrated contexts, and are not intended to limit or define the scope of any particular embodiments. FIGS. 3A and 3B show an illustrative source image 300*a* and a final realized display 300*b*, respectively. The source image 300*a* shows a man riding a road bike. It is desired to convey this source image 300*a* across an entire display field 135 composed of over one-hundred books 310 filling five shelves of a bookcase 315. Notably, it is not desired to simply tile the source image 300*a* across multiple book spines or even to repeat the source image 300*a* on each shelf. Rather, the effective display field 135 is a plane defined by the extents of the bookcase 315, and the display field 135 includes irregular regions of empty space due to different sizes of books 310 on multiple shelves. Accordingly, application of the source image 300*a* to the entire display field 135 involves spreading portions of the source image 300*a* across over one-hundred book spines of different sizes, laid out horizontally and vertically, and accounting for empty spaces to create an overall aesthetic of the source image 300*a* in the final realized display 300*b*.

Figure 4:
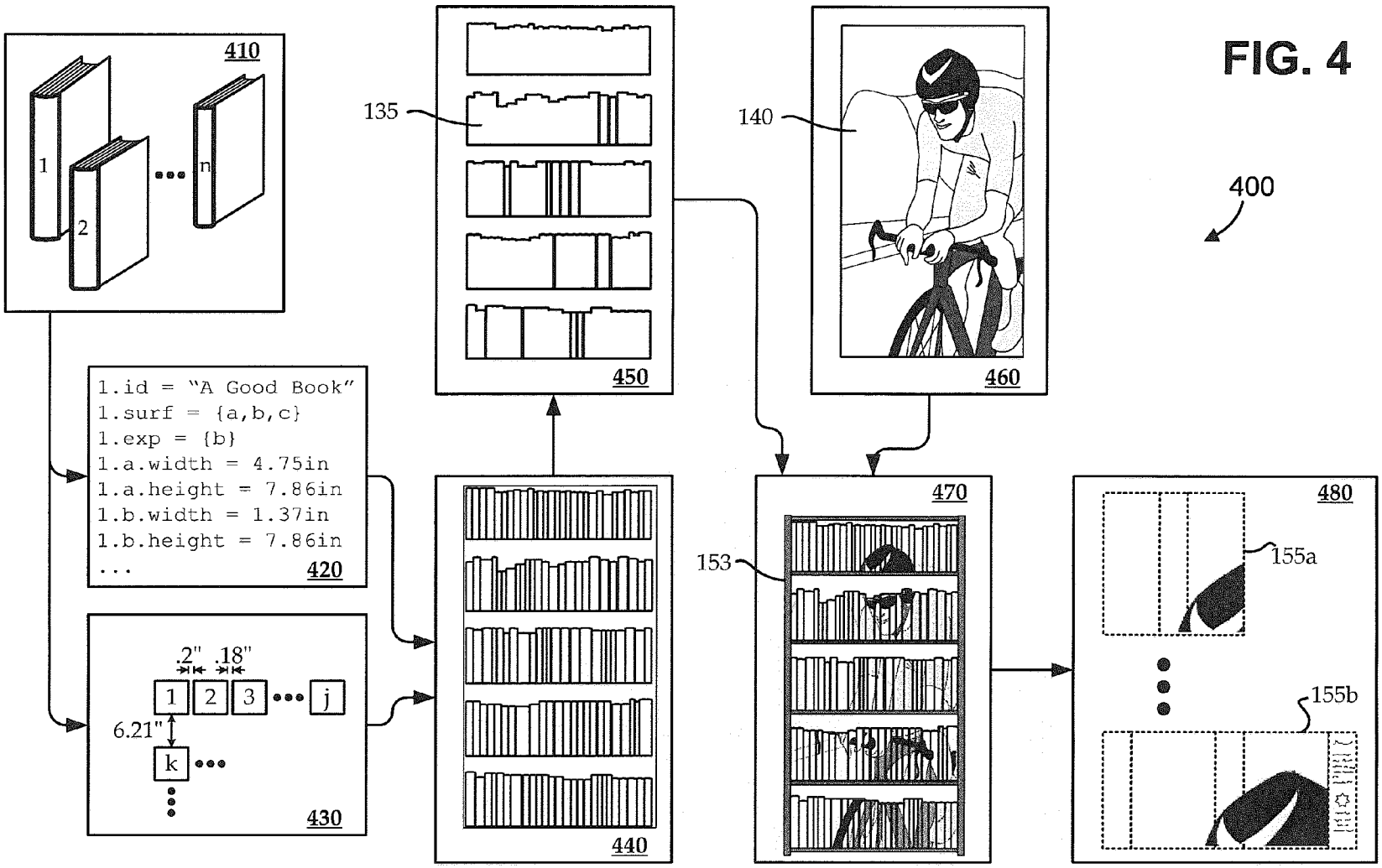
FIG. 4 shows a flow diagram of illustrative stages over which a source image like that of FIG. 3A can become a final realized display like that of FIG. 3B.

FIG. 4 shows a flow diagram 400 of illustrative stages over which a source image like that of FIG. 3A can become a final realized display like that of FIG. 3B. At stage 410, package input data 115 is provided (e.g., to a package characterization subsystem 110). As illustrated, the package input data 115 defines a set of packages (e.g., book jackets) for "Book 1"—"Book n." Each book has an associated size, layout position, orientation, etc. At stages 420 and 430, the package input data 115 is used to generate one or more datasets that include package geometries 123, package layouts 125, and any other relevant information.

In the illustrated embodiment, the dataset at stage 420 is expressed as a hierarchy of objects. The book number identifies a high-level object that has a number of sub-objects as its parameters (e.g., "id," "surf," "exp," etc.). For example, the data indicates that "Book 1" is identified ("1.id") as "A Good Book" (e.g., by its title); includes three defined surfaces ("1.surf={a,b,c}"), of which only surface "b" (e.g., its spine) is exposed to the display field ("1.exp={a}"); surface "a" is 4.75-inches wide by 7.86-inches tall ("1.a.width=4.75; 1.a.height=7.86"); etc. The dataset at stage 430 expresses the package layout 125 as an array of package objects with a particular arrangement and spacing. For example, "Book 1" is horizontally adjacent to "Book 2" with a spacing of 0.2-inches, and "Book 1" is vertically adjacent to "Book k" with a spacing of 6.21-inches. The particular datasets illustrated at stages 420 and 430 are intended to be simplified and illustrative; embodiments can use any suitable data in any suitable data format or arrangement.

At stages 440 and 450, the package geometries 123 and package layouts 125 of stages 420 and 430 are used to determine a display field 135. For example, at stage 440, a display field characterization subsystem 130 virtually arranges all the defined packages according to their package geometries 123 and package layouts 125 to determine which surfaces are visible, and their respective sizes, shapes, orientations, etc. At stage 450, this information is compiled into a set of surfaces (e.g., planes, polygons, masks, etc.) that define the display field 135.

At stage 460, a source image 140 is provided (e.g., the source image 300*a* discussed with reference to FIG. 3A). The source image 140 of stage 460 is mapped to the display field 135 of stage 450 to generate one or more field maps 153 at stage 470. Notably, the filed maps 153 account for the different sizes of visible surfaces and the resulting empty space that will be present in the realized display (e.g., the vertical space between each book and the bottom of the bookcase structure above it). The field maps 153, package geometries 123, and other information can be used (e.g., by a package image generation subsystem 150) to generate package images 155 at stage 480. As shown, package image 155*a* is a three-panel book cover (e.g., a custom book binding to print for an e-book), while package image 155*b* is a five-panel book cover (e.g., a custom book jacket to wrap over an existing book binding). Both package images 155 are generated to support the display of the proper portion of the source image 140 in the region of the exposed spine surface, while also supporting imaging of remaining surfaces of each book cover (including those not visible in the display field 135.

Figure 5A:
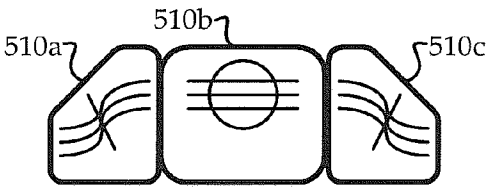
FIGS. 5A-5C show another illustrative use case for generating a final realized display from a source image.
Figure 5B:
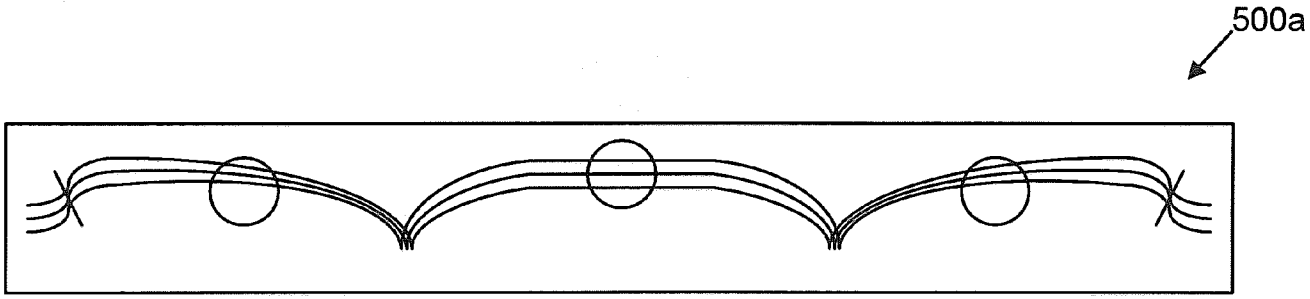
Figure 5C:
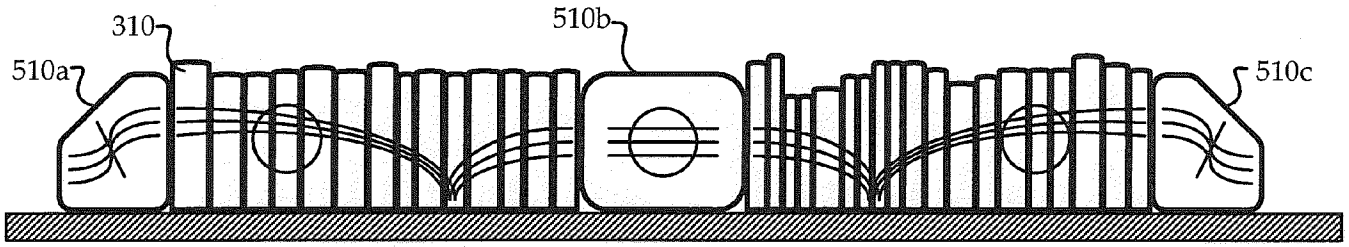

FIGS. 5A-5C show another illustrative use case for generating a final realized display 500*c* from a source image 500*b*.

As illustrated in FIG. 5A, the scenario assumes that a user purchased a sculpture composed of three shaped stones 510, each having an etched design that substantially flows into the design of its adjacent stone(s). The user desires to use the stones 510 as bookends and to build a bookshelf aesthetic around them. As illustrated in FIG. 5B, the user designs a source image 500*b* that effectively extends the designs on the stones (to fill area between the stones). It is desired to convey this source image 300*a* across the entire display field 135, which is composed of a number of books 310 on a single shelf, with a first of the stones 510*a* on one side of the books 310, a second of the stones 510*b* in the middle of the books, and the third of the stones 510*c* on the other side of the books (so that stones 510*a* and 510*c* are effectively bookends). As illustrated in FIG. 5C, the final realized display 500*c* conveys the desired aesthetic across the exposed book spines and the three stones 510 of the sculpture. Application of the design across the product packages (i.e., the book jackets) accounts for the existing sculptural elements, as objects that obscuring particular surfaces of particular books 310, as objects that affect layout (e.g., the middle stone 510*b* creates appreciable space between the adjacent books 310), and as objects affecting (e.g., contributing to) the display field 135.

Figure 6A:
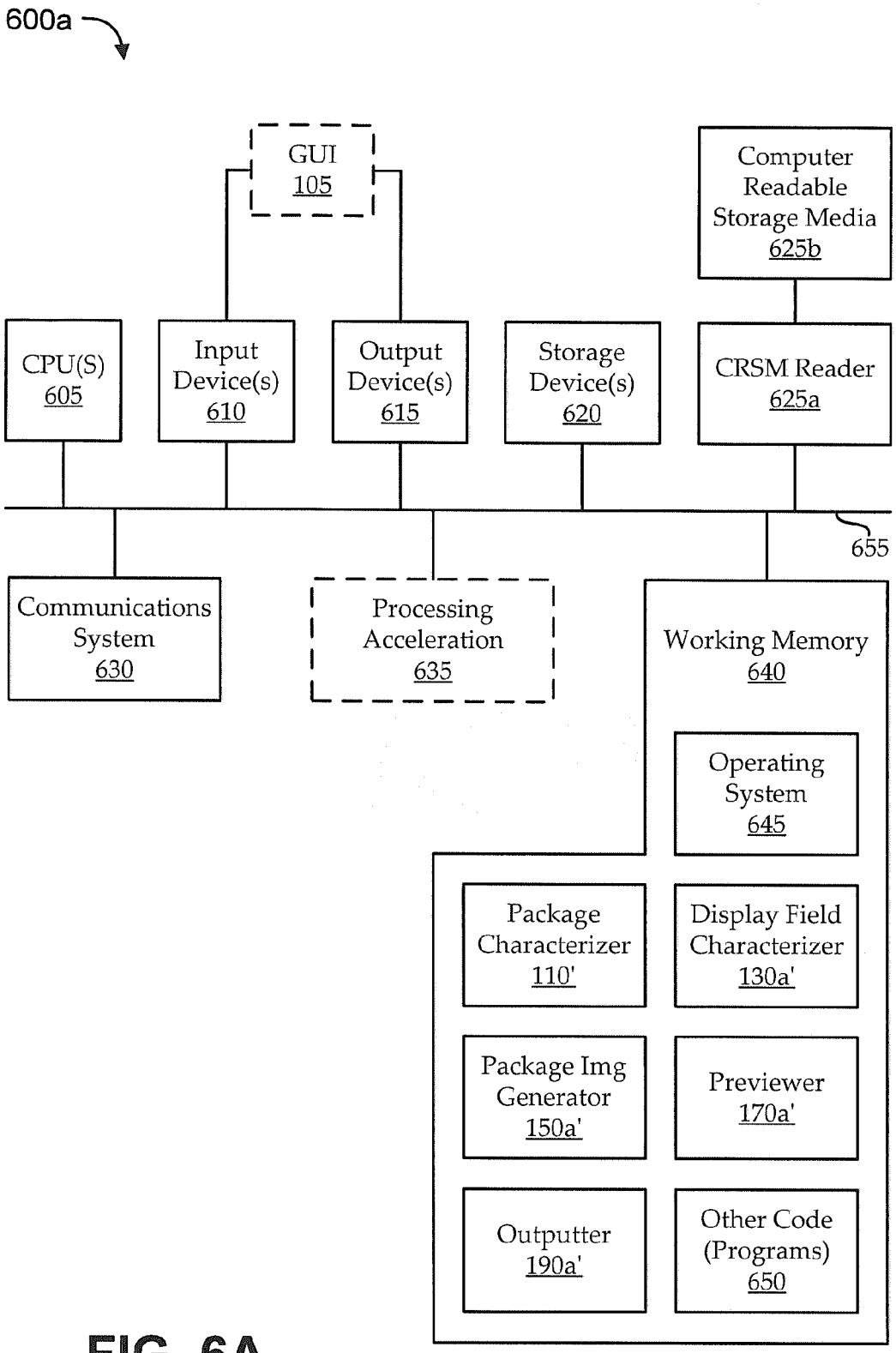
FIG. 6A shows an illustrative computational system for implementing one or more systems or components of systems, according to various embodiments.

FIG. 6A shows an illustrative computational system 600*a* for implementing one or more systems or components of systems, according to various embodiments. The computational system 600*a* is described as implementing functionality of an illustrative product package design environment having most or all of the functionality in a single computational system 600*a*. Embodiments of the computational system 600 can be implemented as or embodied in single or distributed computer systems, or in any other useful way. For example, the computational system 600*a* can be implemented on a desktop, laptop, or tablet computer; a smartphone or other portable interactive media device; a dedicated device, etc.

The computational system 600*a* is shown including hardware elements that can be electrically coupled via a bus 655. The hardware elements can include one or more central processing units (CPUs) 605, one or more input devices 610 and one or more output devices 615 (e.g., a GUI 105, keyboard, mouse, display, touch screen, printer, etc.). The computational system 600*a* can also include one or more storage devices 620. By way of example, storage device(s) 620 can be disk drives, optical storage devices, solid-state storage device such as a random access memory (RAM) and/or a read-only memory (ROM), which can be programmable, flash-updateable and/or the like. In some embodiments, the storage devices 620 are configured to store some or all of the types of data described above with reference to the package data store 240.

The computational system 600*a* can additionally include a computer-readable storage media reader 625*a*, a communications system 630 (e.g., a modem, a network card (wireless or wired) or chipset, an infra-red communication device, etc.), and working memory 640, which can include RAM and ROM devices as described above. In some embodiments, the computational system 600*a* can also include a processing acceleration unit 635, which can include a DSP, a special-purpose processor and/or the like.

The computer-readable storage media reader 625*a* can further be connected to a computer-readable storage medium 625*b*, together (and, optionally, in combination with storage device(s) 620) comprehensively representing remote, local, fixed, and/or removable storage devices plus storage media for temporarily and/or more permanently containing computer-readable information. The communications system 630 can permit data to be exchanged with a public or private network (e.g., network 220) and/or any other system.

The computational system 600 can also include software elements, shown as being currently located within a working memory 640, including an operating system 645 and/or other code 650, such as an application program (which can be a client application, web browser, mid-tier application, relational database management system (RDBMS), etc.). In some embodiments, one or more functions of the product package design environment subsystems are implemented as application code 650 in working memory 640. As illustrated, a package characterizer 110', display field characterizer 130', package image generator 150', previewer 170', and/or outputter 190' can be implemented as applications in working memory 640. These applications can perform some or all of the functionality of their respective subsystems described above, for example, with reference to FIG. 1.

Figure 6B:
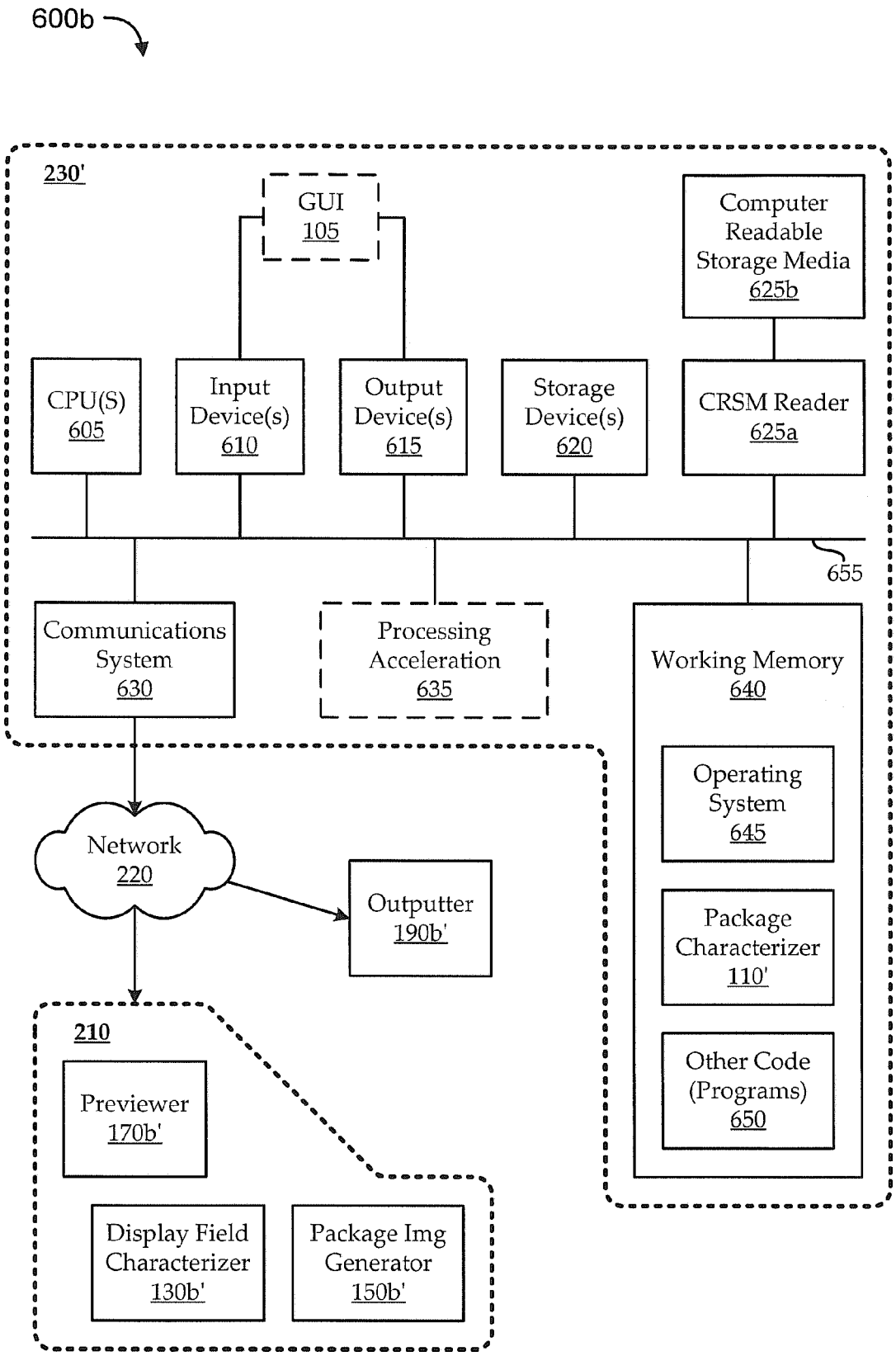
FIG. 6B shows another illustrative computational system for implementing one or more systems or components of systems, according to various embodiments.

FIG. 6B shows another illustrative computational system 600*b* for implementing one or more systems or components of systems, according to various embodiments. The computational system 600*b* is described as implementing functionality of an illustrative client system 230' in communication with an illustrative server system 210 over a network 220 (e.g., as described with reference to FIG. 2). Embodiments of the computational system 600*b* can be implemented in the same or different ways from those described above with reference to FIG. 6A. For the sake of simplicity, similar functional components to those in FIG. 6A are shown in FIG. 6B with similar labels and reference numbers, and descriptions of those components are not repeated.

In the computational system 600*b*, the software elements implemented in working memory 640 are limited to those of a client system 230. For example, in addition to an operating system 645 and/or other code 650, one or more functions of the package characterizer 110' are implemented as application code 650 in working memory 640. The communications system 630 communicatively couples the client system 230' with server system 210 and/or other functionality via one or more networks (e.g., network 220). For example, the client system 230' is in communication over the network 220 with functionality of a package characterizer 110', display field characterizer 130', package image generator 150', previewer 170', and/or outputter 190', some or all of which being part of a server system 210'.

It should be appreciated that alternate embodiments of a computational systems 600 can have numerous variations from that described above. For example, customized hardware might also be used and/or particular elements might be implemented in hardware, software (including portable software, such as applets), or both. Further, connection to other computing devices such as network input/output devices can be employed. In various embodiments a computational system like the ones illustrated in FIGS. 6A and 6B is used to implement one or more functions of a product package design system, and the computational systems 600 can be in communication with other functional components as needed or desired. In other embodiments, computational systems 600 like the ones illustrated in FIGS. 6A and 6B are used to implement one or more method embodiments, such as those described below.

Figure 7:
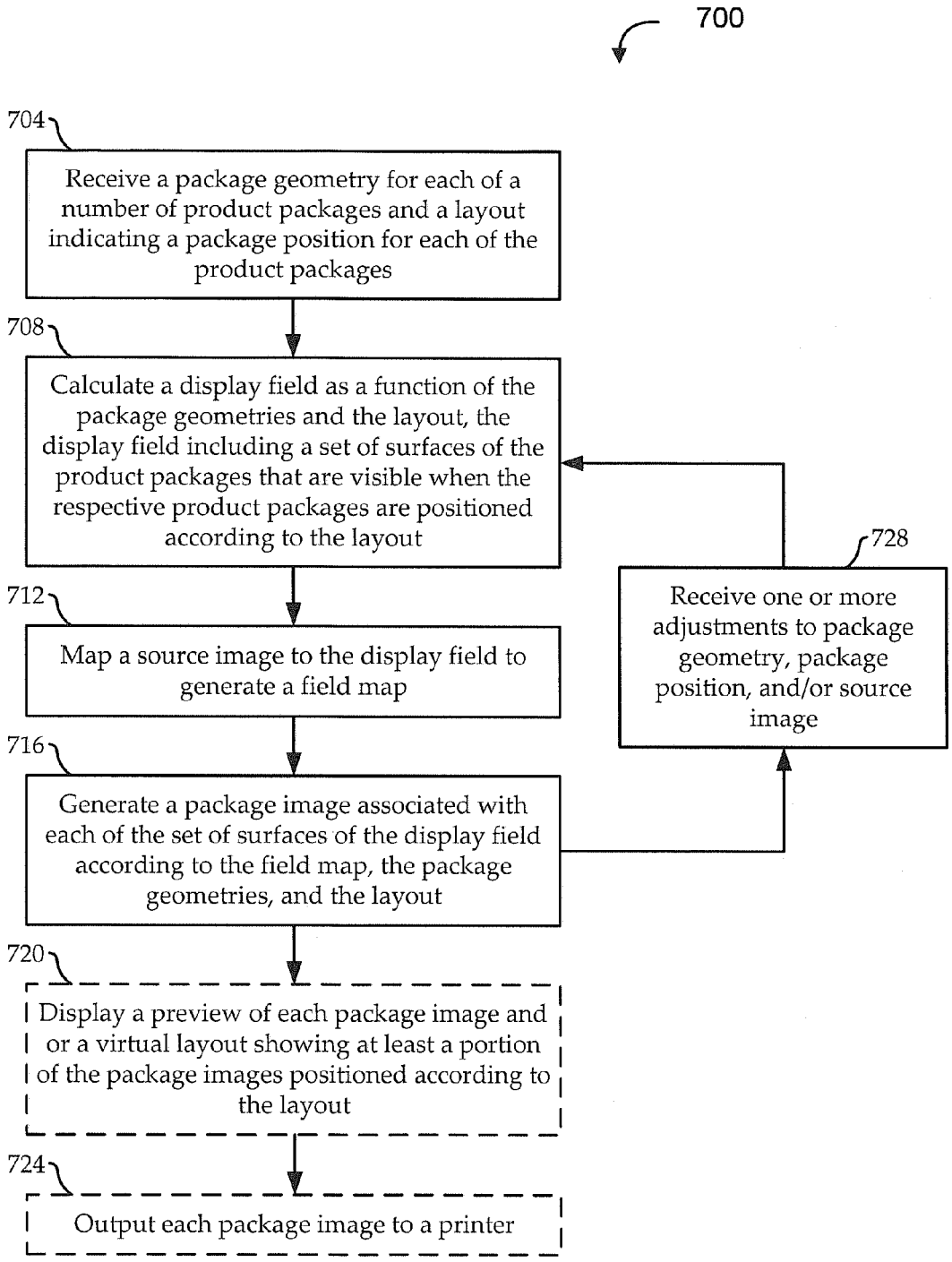
FIG. 7 shows a flow diagram of an illustrative method for applying a design across a display field composed of multiple, non-adjoined packaging surfaces, according to various embodiments.

FIG. 7 shows a flow diagram of an illustrative method 700 for applying a design across a display field 135 composed of multiple, non-adjoined packaging surfaces, according to various embodiments. Embodiments of the method 700 begin at stage 704 by receiving a package geometry for each of a number of product packages and a layout indicating a package position for each of the product packages. For example, as described above with reference to FIG. 1, package input data 115 is provided by a user to a package characterization subsystem 110 (e.g., via a GUI 105). The package characterization subsystem 110 uses the package input data 115 to generate package geometries 123 and package layouts 125. The package geometries 123 and package layouts 125 can be communicated from the package characterization subsystem 110 to a display field characterization subsystem 130 (e.g., over a network, as illustrated in FIG. 2).

At stage 708, a display field is calculated as a function of the package geometries and the layout. The display field is composed of a set of surfaces of the product packages that are visible when the respective product packages are positioned according to the layout. For example, the display field characterization subsystem 130 uses the package geometries 123 and the package layouts 125 to calculate which surfaces are partially or fully obscured by other surfaces (e.g., of other packages or inherently, as in a book jacket flap), and/or, conversely, which surfaces are partially or fully exposed when the packages are laid out according to the package layouts 125. This and/or other information (e.g., viewing direction, additional obscuring objects, etc.) can be used to calculate which portions of the package geometries 123 (e.g., which surfaces) to include in the display field 135.

At stage 712, one or more source images are mapped to the calculated display field to generate one or more field maps. For example, the display field 135 is communicated from the display field characterization subsystem 130 to a package image generation subsystem 150, and the package image generation subsystem 150 maps one or more source images 140 (e.g., supplied by the user) to the received display field 135 to generate one or more field maps 153. In various implementations, the field maps 153 include one or more surfaces with the source images 140 textured thereon, texture maps by which to map the source images 140 to the display field 135 surfaces, etc. The field maps 153 can also include information about how to affect the source images 140, for example, if the mapping involves adjusting (e.g., editing, re-sampling, cropping, rotating, etc.) the source images 140. In some implementations, generation of the field maps 153 can be manually adjusted (e.g., by shifting the mapping of a source image 140, selecting or deselecting portions of the display field 135 for mapping, etc.).

At stage 716, package images are generated in association with each of the set of surfaces of the display field according to the field map, the package geometries, and the layout. For example, the package image generation subsystem 150 uses the field maps 153 and package geometries 123 to determine how to generate a package image 155 that will manifest the desired packaging for each product package, while concurrently manifesting the overall display field 135 aesthetic when the product packages are all displayed according to their package layouts 125. In some implementations, additional information is used to affect how the package images 155 are generated. For example, in the case of a book jacket, additional information can be supplied to dictate how portions of the book jacket that are not visible in the display field 135 will be generated (e.g., where only the spine is visible in the final display, the front and back covers and flaps can include additional artwork, textual information, barcodes, and/or any other content).

In some embodiments, at stage 720, a preview is displayed for review (e.g., by the user). The preview can include one or more package images, a virtual layout showing at least a portion of the package images positioned according to the layout, and/or any useful preview information. In some implementations, the preview also includes ancillary information that can be used for additional determinations, such as an estimated cost to output the generated package images, printing technology requirements (e.g., required or suggested printer hardware and/or software capabilities), storage requirements, etc. Implementations of stage 720 can involve communicating the field maps 153 and/or package images 155 from the package image generation subsystem 150 to a preview subsystem 170, which is operable to generate output previews 175.

Some embodiments of the method 700 further output each package image to an output system at stage 724. For example, the package images 155 are communicated from the package image generation subsystem 150 or the preview subsystem 170 to an output subsystem 190, which is operable to generate package outputs 195. In some implementations, the output subsystem 190 includes one or more printing systems, and the package outputs 195 are printed manifestations of the package images 155. Other types of output subsystems 190 and corresponding package outputs 195 are possible, for example, including, for example, those described above.

As described above, embodiments can dynamically respond to partial changes in input data. For example, after laying out a bookcase full of books and printing custom book jackets, a user may desire to rearrange the books, add or remove books, add additional elements, change the aesthetic (e.g., the source image(s)), and/or otherwise change the display. Rather than redesigning the entire display from scratch, embodiments can simply recalculate, regenerate, etc. as necessary or desired. As illustrated by stage 728, one or more adjustments can be made at one or more stage of the method 700. After generating a complete design (e.g., after field maps and package images have already been generated for one complete concept at stage 716), one or more adjustments can be received (e.g., from a user) with respect to package geometry, package position, and/or source image. For example, if a user changes the order of books on a shelf, only the package layout changes at stage 704. The display field can be recalculated at stage 708 according to the adjusted layout and any previously-provided information (e.g., additional constraints provided by the user), and the source image(s) can be remapped to the new display field at stage 712 to generate new field maps and package images at stage 716.

The methods disclosed herein include one or more actions for achieving the described method. The method and/or actions can be interchanged with one another without departing from the scope of the claims. In other words, unless a specific order of actions is specified, the order and/or use of specific actions can be modified without departing from the scope of the claims.

The various operations of methods and functions of certain system components described above can be performed by any suitable means capable of performing the corresponding functions, including, for example, hardware and/or software. The steps of a method or algorithm or other functionality described in connection with the present disclosure, can be embodied directly in hardware, in a software module executed by a processor, or in a combination of the two. A software module can reside in any form of tangible storage medium. Some examples of storage media that can be used include random access memory (RAM), read only memory (ROM), flash memory, EPROM memory, EEPROM memory, registers, a hard disk, a removable disk, a CD-ROM and so forth. A storage medium can be coupled to a processor such that the processor can read information from, and write information to, the storage medium. In the alternative, the storage medium can be integral to the processor.

A software module can be a single instruction, or many instructions, and can be distributed over several different code segments, among different programs, and across multiple storage media. Thus, a computer program product can perform operations presented herein. For example, such a computer program product can be a computer readable tangible medium having instructions tangibly stored (and/or encoded) thereon, the instructions being executable by one or more processors to perform the operations described herein. The computer program product can include packaging material. Software or instructions can also be transmitted over a transmission medium. For example, software can be transmitted from a website, server, or other remote source using a transmission medium such as a coaxial cable, fiber optic cable, twisted pair, digital subscriber line (DSL), or wireless technology such as infrared, radio, or microwave.

Other examples and implementations are within the scope and spirit of the disclosure and appended claims. For example, features implementing functions can also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

Various changes, substitutions, and alterations to the techniques described herein can be made without departing from the technology of the teachings as defined by the appended claims. Moreover, the scope of the disclosure and claims is not limited to the particular aspects of the process, machine, manufacture, composition of matter, means, methods, and actions described above. Processes, machines, manufacture, compositions of matter, means, methods, or actions, presently existing or later to be developed, that perform substantially the same function or achieve substantially the same result as the corresponding aspects described herein can be utilized. Accordingly, the appended claims include within their scope such processes, machines, manufacture, compositions of matter, means, methods, or actions.

What is claimed is:

1. A method for dynamically applying a design across multiple product packages, the method comprising:

receiving package input data that identifies a plurality of product packages of different three-dimensional shape and different three-dimensional size and a layout indicating a package position for each of the plurality of differently-shaped and differently-sized product packages;

retrieving, in response to and as a function of the received package input data, a package geometry for each of the plurality of product packages;

calculating a display field as a function of the package geometries and the layout, the display field comprising:

a first visible portion of a first product package that is visible when the first product package is positioned according to the layout; and a second visible portion of a second product package that is visible when the second product package is positioned according to the layout, such that the two visible portions manifest a spatial relationship in accordance with the layout;

mapping a source image to the display field to generate a field map using a computer-implemented package image generator, such that the field map indicates a first fragment of the source image corresponding to the first visible portion, and a second fragment of the source image corresponding to the second visible portion, wherein the first fragment is different from the second fragment and the two fragments manifest the spatial relationship with respect to the source image;

generating, by the computer-implemented package image generator, a first package image comprising the first fragment mapped to a region of the first package image that corresponds to the first visible portion; and generating, by the computer-implemented package image generator, a second package image comprising the second fragment mapped to a region of the second package image corresponding to the second visible portion;

wherein the plurality of package images, when the plurality of product packages are arranged in the layout, together form a composite image that replicates the source image, and wherein each of the plurality of package images individually form only a fraction of and less than all of the source image.

2. The method of claim 1, further comprising, subsequent to the generating steps:

receiving an adjusted package position for at least one of the plurality of product packages;

retrieving an adjusted package geometry for each of the at least one product package in response to and as a function of the received adjusted package input data;

recalculating the display field as a function of the package geometries and the layout according to the adjusted package geometry and/or the adjusted package position for the at least one product package;

re-mapping the source image automatically to the recalculated display field to generate an updated field map; and regenerating at least a portion of the package images corresponding to at least one of the visible portions of the display field according to the regenerated field map and the package geometries.

3. The method of claim 1, wherein receiving the package input data and the layout comprises:

receiving package input data and the layout from a user via a graphical user interface;

retrieving the package geometry for each of the plurality of product packages comprises:

transmitting the package input data to a package data store; and receiving the package geometry in response to and as a function of the package input data.

4. The method of claim 1, further comprising:

displaying a preview of each package image.

5. The method of claim 1, further comprising:

displaying a preview of the field map in context of at least a portion of the package geometries positioned according to the layout.

6. The method of claim 1, further comprising:

outputting each package image to a printer.

7. The method of claim 1, wherein:

the layout indicates that the product packages are arranged in at least two dimensions, so that a first package position of a first product package is adjacent to a second package position of a second product package with respect to a first dimension, and a third package position of a third product package is adjacent to the second package position of the second product package with respect to a second dimension that is orthogonal to the first dimension.

8. The method of claim 1, wherein:

a first package position of a first product package is separated from a second package position of a second product package according to the layout so that the display field is calculated to include an empty region between a visible portion of the first product package and a visible portion of the second product package; and the source image is mapped to the display field to generate a field map that accounts for the empty region.

9. The method of claim 1, wherein:

the layout includes an obscuring object arranged to at least partially obscure a portion of at least one product package when the at least one product package is positioned according to the layout; and calculating the display field comprises determining the set of portions of the product packages that are visible when the respective product packages are positioned according to the layout at least by determining which portions of the product packages are obscured by other product packages and/or by the obscuring object.

10. The method of claim 1, wherein the package input data is an International Standard Book Number.

11. The method of claim 1, wherein the first package image is generated on a first removable book cover and the second package image is generated on a second removable book cover.

12. The method of claim 1, wherein the first package image and the second package image each have a portion that overlaps with the other image.

13. The method of claim 1, wherein the multiple product packages are books.

14. A system for dynamically applying a design across multiple product packages, the system comprising:

a display field characterization subsystem operable to:

receive package input data that identifies a plurality of product packages of different three-dimensional shape and different three-dimensional size and a layout indicating a package position for each of the plurality of differently-shaped and differently-sized product packages;

retrieve, in response to and as a function of the received package input data, a package geometry for each of the plurality of product packages; and calculate a display field as a function of the package geometries and the layout, the display field comprising:

a first visible portion of a first product package that is visible when the first product package is positioned according to the layout; and a second visible portion of a second product package that is visible when the second product package is positioned according to the layout, such that the two visible portions manifest a spatial relationship in accordance with the layout;

a package image generation subsystem, in communication with the display field characterization subsystem, and operable to:

map a source image to the display field to generate a field map such that the field map indicates a first fragment of the source image corresponding to the first visible portion, and a second fragment of the source image corresponding to the second visible portion, wherein the first fragment is different from the second fragment and the two fragments manifest the spatial relationship with respect to the source image;

generate a first package image comprising the first fragment mapped to a region of the first package image that corresponds to the first visible portion; and generate a second package image comprising the second fragment mapped to a region of the second package image corresponding to the second visible portion;

wherein the plurality of package images, when the plurality of product packages are arranged in the layout, together form a composite image that replicates the source image, and wherein each of the plurality of package images individually form only a fraction of and less than all of the source image.

15. The system of claim 14, further comprising:

a package characterization subsystem, in communication with the display field characterization subsystem, and operable to:

receive package input data from a user;

transmit the package input data to a package data store; and receive the package geometry for at least one product package from the package data store.

16. The system of claim 15, wherein:

the package characterization subsystem comprises a graphical user interface; and the package input data is received from the user via the graphical user interface.

17. The system of claim 15, wherein:

at least a part of the package characterization subsystem is implemented in a client system in communication with a server system over a communications network; and the server system comprises the display field characterization subsystem and the package image generation subsystem.

18. The system of claim 15, further comprising:

a package data store, in communication with the package characterization subsystem, and operable to store package data for a plurality of product packages, wherein the package characterization subsystem is operable to receive package geometry for at least one of the plurality of product packages by:

querying the package data store according to the package input data; and receiving at least some of the package geometry for the at least one product package from the package data store in response to the query.

19. The system of claim 14, wherein:

the display field characterization subsystem is operable, upon receiving an adjusted package geometry and/or an adjusted package position for at least one of the plurality of product packages, to automatically recalculate the display field as a function of the package geometries and the layout according to the adjusted package geometry and/or the adjusted package position for the at least one product package; and the package image generation subsystem is operable, in response to receiving the recalculated display field, to:

re-map the source image to the recalculated display field to generate an updated field map; and regenerate at least a portion of the package images corresponding to one of the visible portions of the display field according to the regenerated field map and the package geometries.

20. The system of claim 14, further comprising:

a preview subsystem, in communication with the package image generation subsystem, and operable to display a preview of each package image.

21. The system of claim 14, further comprising:

a preview subsystem, in communication with the package image generation subsystem, and operable to display a preview of the field map in context of at least a portion of the package geometries positioned according to the layout.

22. The system of claim 21, further comprising:

a graphical user interface, wherein the preview subsystem is operable to display the preview of the field map as a virtual three-dimensional preview, and the graphical user interface permits interactive, three-dimensional user manipulation of the preview.

23. The system of claim 14, further comprising:

an output subsystem, in communication with the package image generation subsystem, and operable to output each package image to a printer.

24. The system of claim 14, wherein:

the package image generation subsystem is further operable to:

generate the package image associated with the at least one product package, so that additional content separate from the source image is mapped to a non-visible portion of the product package.

* * * * *